United States Patent [19]

Lew

[11] 4,433,711

[45] Feb. 28, 1984

[54] COIL CURTAIN

[76] Inventor: Hyok S. Lew, 7890 Oak St., Arvada, Colo. 80005

[21] Appl. No.: 20,495

[22] Filed: Mar. 14, 1979

[51] Int. Cl.[3] ..... A47H 1/00

[52] U.S. Cl. ..... 160/120; 160/241

[58] Field of Search ..... 160/120–122, 160/241

[56] References Cited

U.S. PATENT DOCUMENTS

| | | | |
|---|---|---|---|
| 669,321 | 3/1901 | Holwager et al. | 160/121 |
| 1,469,150 | 9/1923 | Church | 160/121 C |
| 3,306,344 | 2/1967 | Youngs | 160/241 |

FOREIGN PATENT DOCUMENTS

| | | | |
|---|---|---|---|
| 2260348 | 6/1974 | Fed. Rep. of Germany | 160/122 |

*Primary Examiner*—Rodney H. Bonck

[57] ABSTRACT

A curtain for the window or skylight, etc., comprising a plurality of coiling sheets connected to each other in series is disclosed. One end of first coiling sheet is spliced to an adjacent end of the second coiling sheet in such a way that the said first and the said second coiling sheets coil together about the common axis which is the line of splicing of said two coiling sheets. The other end of the first coiling sheet is similarly spliced to the adjacent end of the third coiling sheet. A fourth and a fifth coiling sheets can be spliced to said second and third coiling sheets in the same manner and so forth. In the "coiled up state" which is the retracted state of the coil curtain, the coil curtain is of the configuration of a series of rolls of the coiling sheets adjoining each other. When the coil curtain is stretched, each of rolls of the coiling sheets unrolls and the coil curtain extends wherein the residual coils of the coiling sheets left after unrolling plays the role of stiffeners keeping the coil curtain stretched laterally.

10 Claims, 9 Drawing Figures

COIL CURTAIN

The ideal curtain shielding the glass window and skylights, etc., should be of light weight, inexpensive and fit within the window frame and thus leave no gaps for air movement, and it should open all the way leaving the entire window unobstructed for sun light and viewing. The progress of the modern plastic technology resulted in a number of different plastic curtains which are radically different from traditional fabric draperies. However, most of the plastic curtains available in the present day market have many short-comings in economy as well as in technology. There is no viable alternative to the widely used fabric drapery at the present time in spite of the high cost and the poor insulating efficiency of the fabric drapery.

The primary object of the present invention is to provide a plastic curtain (or plastic-fabric hybrid type) that is superior to the conventional fabric curtain in economy, insulation, practicality and appearance.

Another object of the present invention is to provide a "coil curtain" which retracts to a series of coiling rolls when retracted and which unrolls into a sheet reinforced with a series of uniformly spaced residual rolls which is left over of the initial coiling rolls in retracted state.

A further object of the present invention is to provide a "coil curtain" which fits within the window frame, whereby there is no air movement across the closed curtain.

Still another object of the present invention is to provide a "coil curtain" which is of light weight.

Still a further object of the present invention is to provide a "coil curtain" of multi-layer structure for high degree of insulation against heat loss.

Yet another object of the present invention is to provide a "coil curtain" which is capable of adjusting the degree of the light transmission.

These and other objects of the present invention will become clear as the specification thereof proceeds. The present invention may be described with greater clarity and specificity by referring to the FIGS. 1 through 9.

BRIEF DESCRIPTION OF THE DRAWINGS

In FIGS. 1 and 2, there is shown a front view and a side view of a "coil curtain" constructed in accordance with the teaching of the present invention, respectively. The coil curtain 1 is comprised of a series of coiling sheets 2, 3, 4, 5, etc, which sheets coils itself about each end (said coiling capacity can be provided by the coil spring force inherent to the coil sheet or by means of rollers equipped with one or more coil spring connected to the end of coil sheet). The upper end of coil sheet 3 is spliced to the lower end of coil sheet 2 in such a way that said pair of coil sheets rolls together about the axis of splice 6. The lower end of coil sheet 3 and the upper end of coil sheet 4 are spliced to one another along the axis of splice 7. With said arrangements, the coil; sheet 2 and the upper half of coil sheet 3 coils and uncoils about the axis of splice 6, while the lower half of coil sheet 3 and the upper half of coil sheet 4 coils and uncoils about the axis of splice 7. Coil sheet 5 and the lower half of the coil sheet adjacent to coil sheet 5 coils and uncoils about the axis of splice 8. A stiffener 9 with a pair of holes (attachment means) 10 and 11 for fastening to the top of the door frame, is disposed at the upper end of coil sheet 2. Another stiffener 12 with means for holding the coil curtain 1 at different degrees of opening and closing is disposed at the lower end of coil sheet 5. In the embodiment shown in FIG. 1 for the means of holding the coil curtain at an open position includes a pair of fiction feet 14 and 15 pivoting about hingepoints 16 and 17, and frictionally engaging the side of the window frame 22 and 23, respectively. A pair of cord 20 and 21 extending from a handle ring 13 disposed at the mid-length of stifferner 12 are respectively connected to the arms 18 and 19 of friction foot 14 and 15, respectively. When handle ring 13 is pulled downwardly, the friction foot 14 and 15 disengages the door frames 22 and 23 respectively, and consequently the coil curtain 1 is free to move up and down, while the pair of friction foot 14 and 15 maintains the coil curtain at a closed position when the handle ring 13 is released. It should be noticed that the coil sheets 2, 3, 4, 5, etc., employed for the coil curtain 1 have coiling forces in one direction only and consequently, the upper half of a coil sheet coils in a direction opposite to the coiling direction of the lower half.

In FIG. 3 there is shown another embodiment of a "coil curtain" constructed in accordance with the principle of the present invention. In the embodiment the direction of the coiling force on the upper half of a coil sheet comprising the coil curtain 6 is opposite to that on the lower half and, consequently, the upper and lower half of the coil sheet coils in the same direction. Such a coil sheet 24 coiling about the axis of splicing 26 and 27 may be constructed by splicing a pair of coil sheets with opposite coiling actions at midsection 25.

In FIG. 4, there is shown a way of strengthening the lateral stiffness of the coil curtain shown in FIGS. 1 and 2 wherein a stiffener 28 is disposed along the axis of splicing 7. In general, said stiffener 28 extends from one side to the other side of the coil curtain and may be used as a means for splicing the pair of adjoining ends of two adjacent coil sheets 3 and 4.

The coil curtain may be arranged to open and close vertically as well as horizontally. In latter case, there has to be a means for suspending the upper end of the stiffener 28 to the upper member of the window frame. In FIG. 5, there is shown a roller 29 disposed at the end of the stiffener 28, which roller is engaging groove 30 disposed on the window frame. There is shown in FIG. 6 the eye-let 31 rotatably engaging one end of stiffener 28, and slidably engaging a rod or cord 32, which is another means of achieving the same effect of the embodiment shown in FIG. 5. In this embodiment, the stiffener 28 may or may not extend all the way from one side to the other side 8 the coil curtain. When a reasonably thick and strong material such as a steel coil spring sheet or its plastic counter part is used in the construction of the coil curtain, it can be used as a anti-buglary curtain or door when the embodiments shown in FIG. 5 or FIG. 6 are incorporated on both sides of the coil curtain, which may open and close vertically or horizontally.

In FIG. 7 there is an embodiment for a parallel arrangement of the pair of roll curtains 33 and 34, each of which is constructed similarly to the coil curtain 1 shown in FIGS. 1 and 2 (of course, the "attachment means" for attaching the coil curtain to the window frame and "holding means" for holding the coil curtain at certain closed position may be altered to suit the specific parallel configuration). In this particular arrangement of the parallel configuration, plurality of spacer 35, each end of which spacer is rotatably engaged by each end of 36 and 37 of pair of stiffeners 28 respectively belonging to coil curtain 33 and 34. In such a parallel configuration of two coil curtains, each coil curtain may be constructed of coil sheets with striped checkered or dotted patterns combining opaque and translucent portions. By shifting the coil curtains in parallel with respect to each other, the amount of light transparency can be adjusted as required. The parallel arrangement shown in FIG. 7 is recommended for use with the purpose of heat insulation. If the adjustment of light transparency is the only requirement, one may employ the parallel arrangement shown in FIG. 8.

In FIG. 8, there is shown a parallel arrangement of a pair of coil curtains 38 and 39, each of which has essentially the same construction as the coil curtain 1 shown in FIGS. 1 and 2 (the attachment means and holding means may be altered to suit), wherein a plurality of connector 40 are employed to connect said pair of coil curtains. The each end of connector 40 is rotatably engaged by each end 41 and 42 of a adjacent pair of stiffeners 28 respectively belonging to coil curtains 38 and 39. It should be noticed that the adjacent pair of stiffeners 28 belonging to the coil curtain 38 are disposed between a adjacent pair of stiffeners 28 belonging to the coil curtain 39 and vice versa and that the connector 40 is disposed vertically, whereby, the uncoiled portion of the coil curtains 28 and 29 are in direct contact to each other. The stiffener disposed to the lower end roll of the each of the coil curtains 38 and 39 is provided with a pair of arms 43 and 44 extending in two diametrical angles. A cord 45 non-movably engages each of holes disposed at the extremity of each of said arms in such a way that pull of one end 46 or the other end 47 of cord 45 rotates the each of stiffeners disposed at the lower end of each of coil curtains 38 and 39 in two opposing directions respectively, resulting in the parallel shifting of the coil curtains 38 and 39 with respect to each other, which is to adjust the degree of transparency of the combination of the pair of coil curtains 38 and 39, each of which has a pattern employing the opague and transparent portions.

Many windows are of such height that only a single coil sheet with a pair of stiffeners 28 disposed at each end may be required. In FIG. 9, there is shown a parallel combination of a pair of such coil sheets 48 and 49. The each of the upper stiffeners 50 and 51 respectively belonging to each of coil sheets 48 and 49 are connected to each other by a coil spring 54 with a pair of arms 55 and 56. The loops at the extremity of each of said arms are rotatably engaged by the extremity of stiffeners 50 and 51, respectively. The pair of stiffeners 52 and 53 respectively disposed at the lower end of the coil sheets 48 and 49 are similarly connected to each other by a coil spring 58 with a pair of arms 59 and 60. With this arrangement each of pair of rolls of each of coil sheets are pressed toward to each other by the force of coil spring and thus, the uncoiled portion of the pair of the coil sheets are always in contact to one another. The rods 57 and 61 respectively engaging the coils of coil springs 54 and 58 may be used as attachment means and handle means, respectively. The lower stiffeners 52 and 53 are provided with arms 62 and 63, respectively, which arm is non-movably engaged by a cord 64 at each extremity of each arms; whereby, pull of one end 65 or other end 66 of cord 59 rotates the stiffeners 52 and 53 in the same direction resulting in the parallel shifting of the pair of coil sheets with respect to each other. Such an adjustment can be used to adjust the light transparency of the double coil curtain when each of the coil sheet is provided with patterns employing the opaque and transparent segments.

Figure 1:
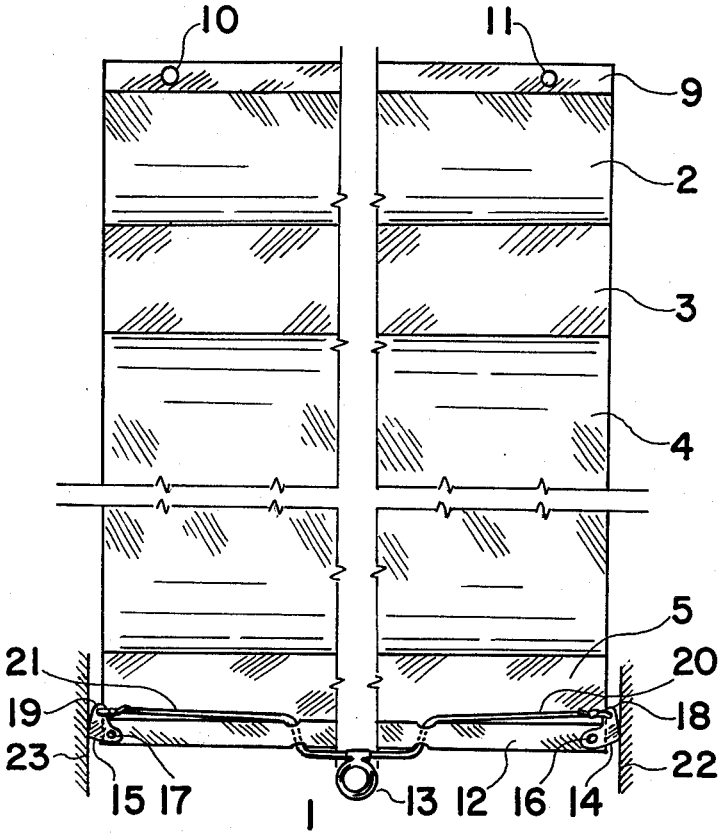
FIG. 1 shows a front view of one embodiment of the invention.
Figure 2:
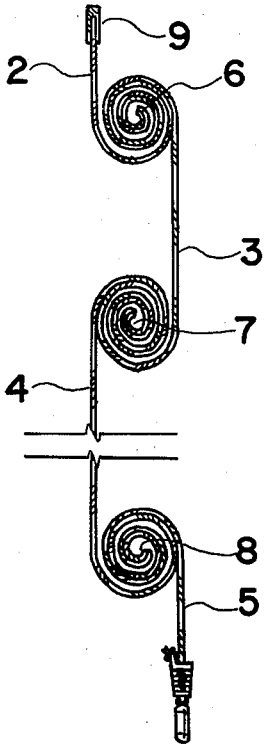
FIG. 2 is a side view of the embodiment of FIG. 1.
Figure 3:
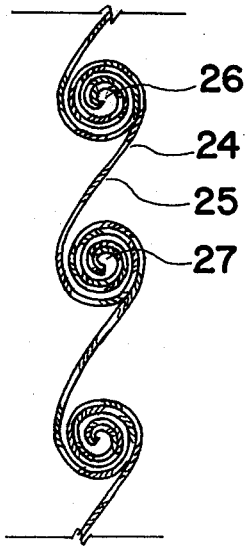
FIGS. 3 and 4 show side views of two alternative embodiments of the invention.
Figure 4:
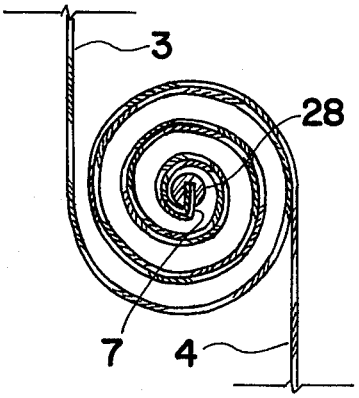
Figure 5:
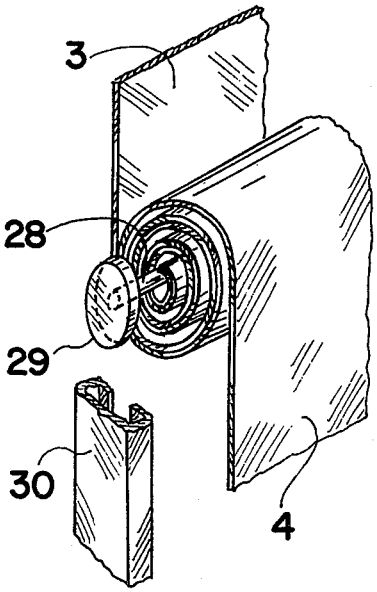
FIGS. 5 and 6 show perspective views of two further embodiments.
Figure 6:
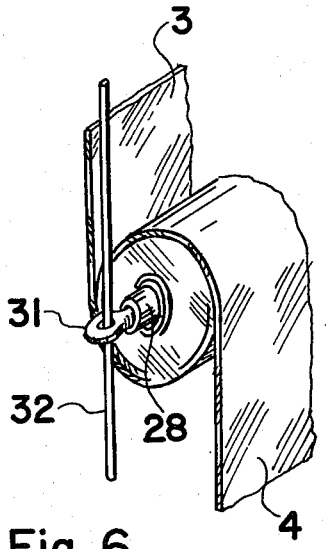
Figure 7:
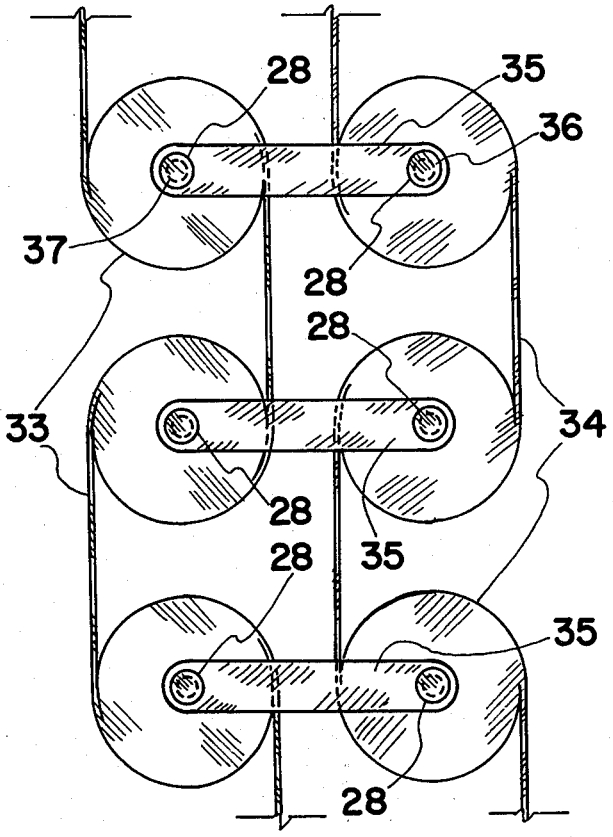
FIGS. 7–9 show side views of still further embodiments of the present invention.
Figure 8:
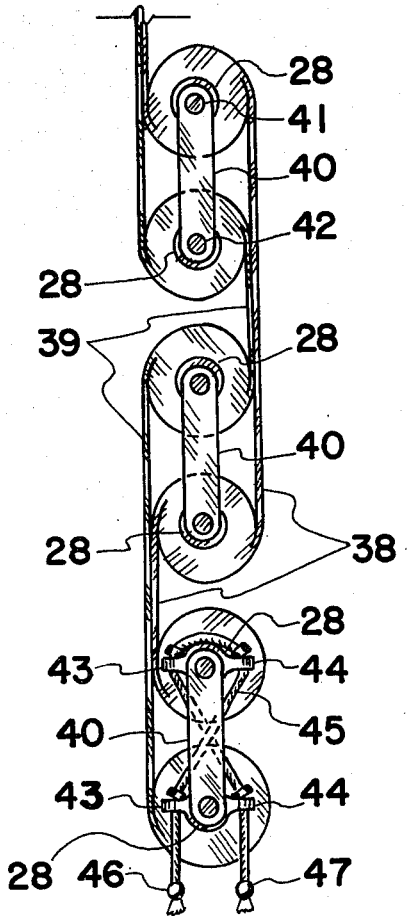
Figure 9:
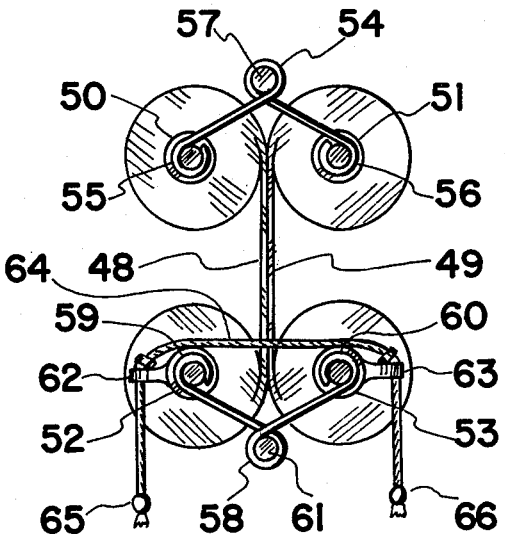

While the principles of the invention have now been made clear in an illustrative embodiment, there will be immediately obvious to those skilled in the art many modifications of the structures, arrangement, proportions, the elements, materials and components used in the practice of the invention which are particularly adapted for specific environments and operating requirements without departing from those principles

I claim:

1. A coil curtain retracting to a series of rolls adjoining to each other when open and extending to a sheet reinforced with a series of uniformly spaced residual rolls when closed, said coil curtain comprising in combination (a) one or more coiling sheets, said coiling sheets rolling itself into one or two coils when an external restraint is absent;

(b) one end of one of said coiling sheets is spliced to the other end of first adjacent coiling sheet of said coiling sheets, wherein said one of said coiling sheets and said first adjacent coiling sheet roll into a coil in the same direction superimposed to each other;

(c) the other end of said one of said coiling sheets is spliced to the one end of second adjacent coiling sheet of said coiling sheets, wherein said one of said coiling sheets and said second adjacent coiling sheet roll into a coil in the same direction superimposed to each other; whereby, one half of said one of said coiling sheets and the other half of said first adjacent coiling sheet roll into one coil, and the other half of said one of said coiling sheets and the one half of said second adjacent coiling sheet roll into the other coil.

2. The combination set forth in claim 1 wherein an attachment means for fastening said coil curtain to the window frame is disposed on one extremity of said coil curtain and a holding means for maintaining said coil curtain a certain closed position is disposed at the other extremity of said coil curtain.

3. The combination as set forth in claim 2 wherein a plurality of stiffener is disposed along each of the line of splicing, which line of splicing is the line where two adjoining end of two adjacent coiling sheets are spliced to each other.

4. The combination as set forth in claim 3 wherein a guide means slidably engaging a guide rail disposed on the window frame is disposed at the extremity of said stiffener; whereby, said coil curtain is restrained on a plane on which said coil curtain closes and opens.

5. A coil curtain including a pair of coiling sheets, each of said coiling sheets rolled into a pair of rolls of coiled sheets about each of a pair of stiffeners disposed at each of both extremities of each of said coiled sheets, are connected to one another by two pair of coil springs, each of the matching extremities of said stiffeners rotatably engaging loops disposed at each extremity of arms of said coil spring; whereby each pair of matching rolls of said pair of coiling sheets are pressed toward to each other.

6. The combination as set forth in claim 5 (10) wherein each of said pair of coiling sheets is provided with a geometric pattern of opaque and transparent segments, and means for shifting each coiling sheet relative to each other, whereby, the light transparency is adjustable.

7. A coil curtain assembly comprising two or more coil curtains arranged in parallel, each of said two or more coil curtains including in combination:

(a) one or more coiling sheets, said coiling sheets rolling itself into one or two coils when an external restraint is absent;

(b) one end of one of said coiling sheet is spliced to the other end of first adjacent coiling sheet of said coiling sheets, wherein said one of said coiling sheets and said first adjacent coiling sheet roll into a coil in the same direction superimposed to each other;

(c) the other end of said one of said coiling sheets is spliced to the one end of second adjacent coiling sheet of said coiling sheets, wherein said one of said coiling sheets and said second adjacent coiling sheet roll into a coil in the same direction superimposed to each other; whereby, one half of said one of said coiling sheets and the other half of said first adjacent coiling sheet roll into one coil, and the other half of said one of said coiling sheets and one half of said second adjacent coiling sheet roll into the other coil;

wherein a plurality of horizontal spacers are rotatably engaged by each extremity of each of matching coils of coiling sheets respectively belonging to each of said two or more said coil curtains whereby, the gap between said two or more of said coil curtains is maintained and the heat loss across said coil curtain assembly is checked.

8. The combination as set forth in claim 7 wherein each of said two or more of said coil curtain has a geometric pattern employing opaque and transparent segments; whereby, the light transparency through said coil curtain assembly is adjustable by shifting the individual coil curtains within said coil curtain assembly relative to each other.

9. A coil curtain assembly comprising two or more coil curtains arranged in parallel, each of said two or more coil curtains including in combination:

(a) one or more coiling sheets, said coiling sheets rolling itself into one or two coils when an external restraint is absent;

(b) one end of one of said coiling sheet is spliced to the other end of first adjacent coiling sheet of said coiling sheets, wherein said one of said coiling sheets and said first adjacent coiling sheet roll into a coil in the same direction superimposed to each other;

(c) the other end of said one of said coiling sheets is spliced to the one end of second adjacent coiling sheet of said coiling sheets, wherein said one of said coiling sheets and said second adjacent coiling sheet roll into a coil in the same direction superimposed to each other; whereby, one half of said one of said coiling sheets and the other half of said first adjacent coiling sheet roll into one coil, and the other half of said one of said coiling sheets and one half of said second adjacent coiling sheet roll into the other coil;

wherein a plurality of vertical connectors are rotatably engaged by each extremity of each of matching coils of coiling sheets respectively belonging to each of said two or more coil curtains; whereby the uncoiled portion of said two or more coil curtains are in contact to one another.

10. The combination as set forth in claim 9 wherein each of said two or more coil curtains is provided with a geometric pattern of opaque and transparent segments and means for shifting each of coil curtains of said coil curtain assembly is included; whereby, the light transparency through said coil curtain assembly is adjustable.

* * * * *